US006441561B1

(12) United States Patent
Tsai

(10) Patent No.: US 6,441,561 B1
(45) Date of Patent: Aug. 27, 2002

(54) CRACK DETECTING DEVICE FOR PLASMA DISPLAY PANEL

(75) Inventor: Chung-Kuang Tsai, Hsinchu Hsien (TW)

(73) Assignee: AU Optronics Corp., Hsinchu (TW)

( * ) Notice: Subject to any disclaimer, the term of this patent is extended or adjusted under 35 U.S.C. 154(b) by 0 days.

(21) Appl. No.: 09/931,614

(22) Filed: Aug. 16, 2001

(30) Foreign Application Priority Data

Dec. 19, 2000 (CN) ..... 08912752

(51) Int. Cl.[7] ..... G09G 3/28

(52) U.S. Cl. ..... 315/169.1; 315/169.3

(58) Field of Search ..... 315/366, 410, 315/169.1, 169.3

(56) References Cited

U.S. PATENT DOCUMENTS 4,326,151 A * 4/1982 Weisbrod ..... 315/410

* cited by examiner

*Primary Examiner*—David Vu
(74) *Attorney, Agent, or Firm*—Ladas & Parry

(57) ABSTRACT

A plasma display panel includes a front substrate having a first edge and a second edge in opposition to each other, a signal transmitter positioned at the first edge of the front substrate, a signal receiver disposed on the second edge of the front substrate, a detecting wire disposed on the front substrate, and a control circuit coupled to the signal transmitter and the signal receiver. The detecting wire has a first end and a second end, the first end is coupled to the signal transmitter, and the second end is coupled to the signal receiver. When a detecting signal is transmitted by the signal transmitter and is not received by the signal receiver, the control circuit interrupts the bias applied between a plurality of sustaining electrodes and a plurality of scanning electrodes.

14 Claims, 5 Drawing Sheets

CRACK DETECTING DEVICE FOR PLASMA DISPLAY PANEL

BACKGROUND OF THE INVENTION

1. Field of the Invention

The present invention relates to a device and method of detecting glass cracks. More particularly, it relates to a device and method of detecting cracks in a plasma display panel (hereinafter referred to as PDP).

2. Description of the Related Art

FIG. 1 is a cross-sectional view of a single cell in a conventional PDP. The PDP includes a front substrate 1, and a rear substrate 7. The front substrate 1 has at least a sustaining electrode X, at least a scanning electrode Y which is parallel to the sustaining electrode X, a dielectric layer 3, and a protective film 5. The rear substrate 7 has at least one addressing electrode A and a fluorescent layer 9. The addressing electrode A is perpendicular to the sustaining electrode X and the scanning electrode Y. Further, partition walls 8 are formed to isolate each PDP cell.

FIG. 2 is a block diagram illustrating a plasma display panel (PDP) 100 formed by the PDP cells shown in FIG. 1. The PDP 100 is driven by the scanning electrodes Y1~Yn, the sustaining electrodes X1~Xn, and the addressing electrodes (not shown). Furthermore, the PDP 100 includes the control circuit 110, the scanning driver (Y driver) 112, the sustaining driver (X driver) 114, and the addressing driver (not shown). The control circuit 110 generates timing signals for all drivers according to the external clock signal CLOCK, the data signal DATA, the vertical synchronous signal $V_{SYNC}$, and the horizontal synchronous signal $H_{SYNC}$. The clock signal CLOCK represents the data transmittal clock, and the data signal DATA represents the display data. The vertical synchronous signal $V_{SYNC}$ and the horizontal synchronous signal $H_{SYNC}$ are used to define the timing sequences of a single frame and a single scanning line, respectively. The control circuit 110 delivers the display data and the clock signal to the addressing driver, and also delivers the corresponding frame control clock via signal lines 102 to the scanning driver 112 and the sustaining driver 114.

FIG. 3 is a diagram illustrating the driving method to display a single frame of the conventional PDP. As shown, each frame is divided into eight sub-fields SF1~SF8. Each sub-field has three periods including the reset period R1~R8, the address period A1~A8, and the sustain period S1~S8. In the reset period, the residual charges of the preceding sub-field is cleared and a small amount of the wall charges is produced in the present sub-field. During the address period, wall charges are accumulated in the displayed sub-field, in other words, it is used to "turn on" the sub-field. Further, discharging will be continued during the sustain period for displaying images. During the reset period R1~R8 or the sustain period S1~S8, all of the sub-fields are processed at the same time. On the other hand, the address step is sequentially performed for each cell on the scanning electrodes Y1~Yn during the address period A1~A8. Moreover, the display brightness is proportional to the length of the sustain period S1~S8. In the example of FIG. 3, the length of the sustain periods S1~S8 of the sub-fields SF1~SF8 can be set in a ratio of 1:2:4:8:16:32:64:128 to display images in 256 gray scales.

FIG. 4 is a timing diagram of the control signals on sustaining electrodes X and scanning electrodes Y in a single sub-field of the prior art. The signals on the sustaining electrodes X are generated by the sustain driver 114, and the signals on the scanning electrodes Y are generated by the scan driver 112. As shown in the drawing, each sub-field includes the reset period, the address period and the sustain period. It should be noted that the waveform of driving signals shown in the drawing is only an example. The waveform varies in practice, but the same theory is applied.

A PDP is a device with electrodes driven by a high voltage (the voltage can reach around 200 volts). If the front substrate cracks to expose the electrodes (due to a sudden hit, for example), the user may get an electric shock. Therefore, it is necessary to design a device that can detect cracks on the substrate and stop the operating circuit.

A conventional way to detect a glass crack is disclosed. For example, in the common building, a detector is attached to the window and used to detect the glass crack and give an alarm. However, this kind of detector is too bulky to be applied on the thin PDP.

Accordingly, the present invention provides a plasma display panel with an elongated wire extended beyond both edges of the panel to carry a specified signal for detecting cracks. When a front substrate cracks, the specified signal is vanished. After a detect circuit detects the disappearance of the specified signal, the detect circuit will notify the control circuit to turn off the power. The wire can be positioned on the front substrate and be manufactured by the same step for forming other electrodes without resulting in extra manufacturing steps.

To achieve above-mentioned object, the invention provides a plasma display panel (PDP) having a plurality of pixels, a plurality of sustaining electrodes, and a plurality of scanning electrodes. When a bias is applied to the plurality of sustaining electrodes and the plurality of scanning electrodes, a discharge operation is performed in the plurality of pixels. The plasma display panel of the present invention includes: a front substrate having a first edge and a second edge in opposition to each other, a signal transmitter disposed on the first edge of the front substrate, a signal receiver disposed on the second edge of the front substrate, a detecting wire disposed on the front substrate, and a control circuit coupled to the signal transmitter and the signal receiver. The detecting wire has a first end and a second end, the first end is coupled to the signal transmitter, and the second end is coupled to the signal receiver. When the signal transmitter sends a detecting signal and the signal receiver doesn't receive the detecting signal, the control circuit interrupts the bias applied between the plurality of sustaining electrodes and the plurality of scanning electrodes so as to stop the discharge operation in the plurality of pixels.

The signal receiver sends a notifying signal to the control circuit when not receiving the detecting signal. The control circuit will turn off the power of the plasma display panel so as to stop the operation of the signal transmitter after receiving the notifying signal.

Moreover, the plasma display panel of the present invention further includes: a rear substrate positioned opposite to the front substrate and having a plurality of addressing electrodes, a dielectric layer covered the sustaining electrodes and the scanning electrodes, and a protective film covered the dielectric layer.

The present invention further provides another structure of the PDP that can detect glass cracks. In this embodiment, the detecting wires are not formed in the non-display area, instead, the detecting wires can be formed in the display area. Several specified display electrodes are extended from one edge of the substrate to another edge of the substrate to form the detecting wires. The signal transmitter can be replaced by a scan driver or a sustain driver for controlling the scanning electrodes or the sustaining electrodes. The driving signal of these drivers can be transmitted to the signal receiver through the detecting wire. The signal receiver can detect the state of the driving signals at a specified time for determining an open circuit cause by the crack of the glass substrate. If there is an open circuit on the detecting wire, the control circuit will be notified. The present invention can detect not only a glass crack but also an error waveform of the driving signal. Therefore, the self-testing function of the circuit is provided.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

First Embodiment

Figure 5:
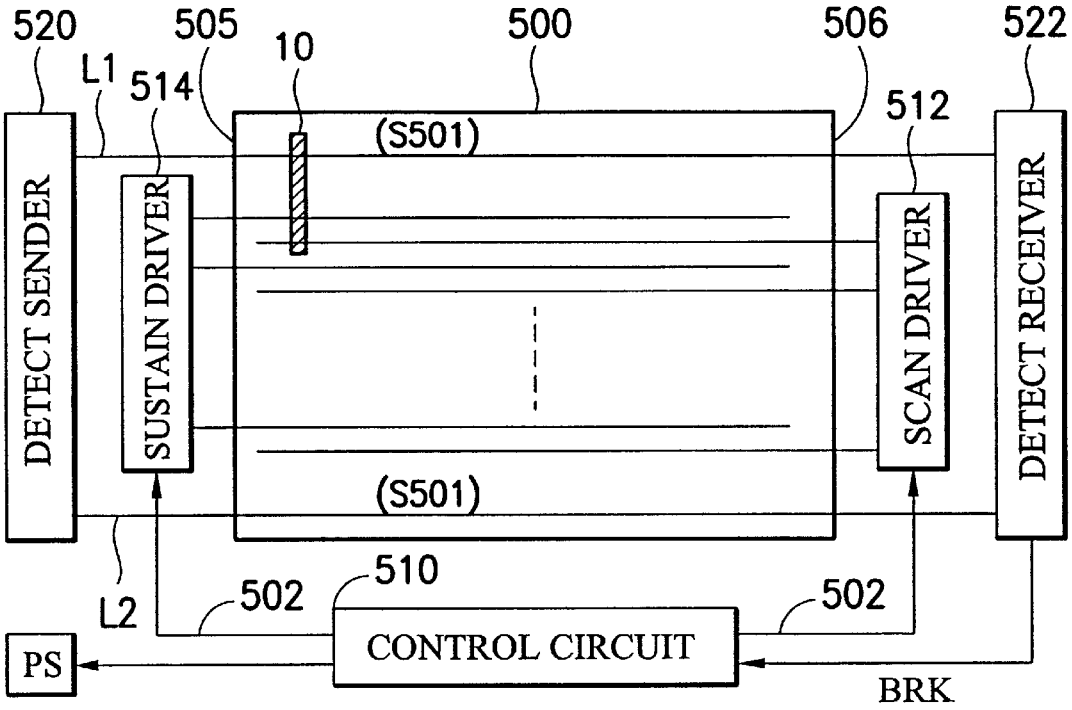
FIG. 5 is a diagram illustrating a plasma display panel according to a first embodiment of this invention.
Figure 8:
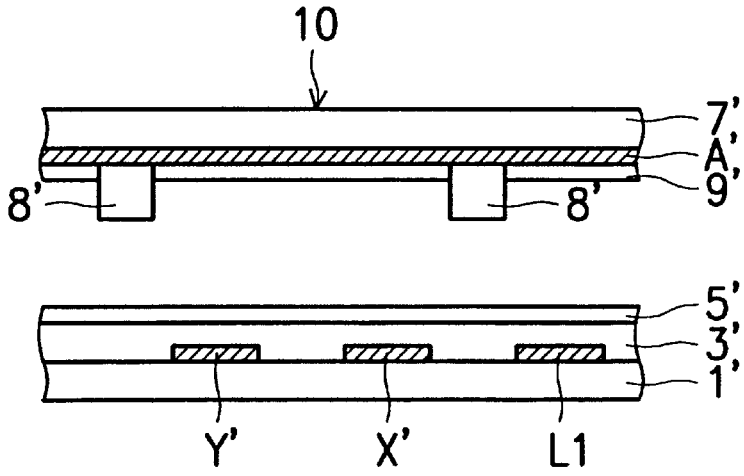
FIG. 8 is a cross-sectional view of a cell in the PDP according to the first embodiment of this invention.

Referring to FIG. 5 and FIG. 8, FIG. 5 is a diagram illustrating a plasma display panel (PDP) of the present embodiment. FIG. 8 is a cross-sectional view of a cell 10 in the PDP.

As shown in FIG. 8, the plasma display panel has a front substrate 1' and a rear substrate 7'. The components formed on the front substrate 1' include the scanning electrodes Y', the sustaining electrodes X' parallel to the scanning electrodes Y', a detecting wire L1, a dielectric layer 3', and a protective film 5'. The components formed on the rear substrate 7' include the addressing electrodes A', partition walls 8' formed on both sides of addressing electrodes A', and the fluorescent material 9' formed between the partition walls 8'. The PDP has a plurality of pixels 10, and a discharge operation will be performed when a bias is applied between the sustaining electrodes X' and the scanning electrodes Y'.

Referring to FIG. 5, the detecting wires L1 and L2 are formed on the front substrate 1' of the PDP 500. The detecting wires L1 and L2 are formed near the edges of the PDP 500 and formed in the non-display area. The detecting wires L1 and L2 are formed extend from the first edge 505 to the second edge 506 in opposition to the first edge 505. Both ends of the detecting wires L1, L2 are respectively coupled to the signal transmitter 520 and the signal receiver 522. When the glass substrate is broken and the detecting wires L1 and L2 are open, the signal receiver 522 can't receive the signal of the signal transmitter 520 and sends a notifying signal BRK to the control circuit 510. The control circuit will turn off the power supply PS of the PDP after receiving the notifying signal BRK. The operation process is described as follows.

At first, the signal transmitter 520 sends a specified signal S501 via the detecting wires L1, L2 and then the signal receiver 522 may detect whether the detecting signal S501 exist or not. If the detecting signal S501 does not exist, the detecting wires L1 and L2 might be broken due to cracks of the glass substrate. At that time, the signal receiver 522 will send a notifying signal BRK to the control circuit 510. After receiving the notifying signal BRK via the wire 502, the control circuit 510 interrupts the bias applied between the sustaining electrodes X' and the scanning electrodes Y' so as to stop the discharge operation in the pixels 10. Further, the control circuit 510 can also stop the operations of the sustain driver 514 and the scan driver 512, and turn off the power supply PS of the PDP.

Second Embodiment

Figure 6:
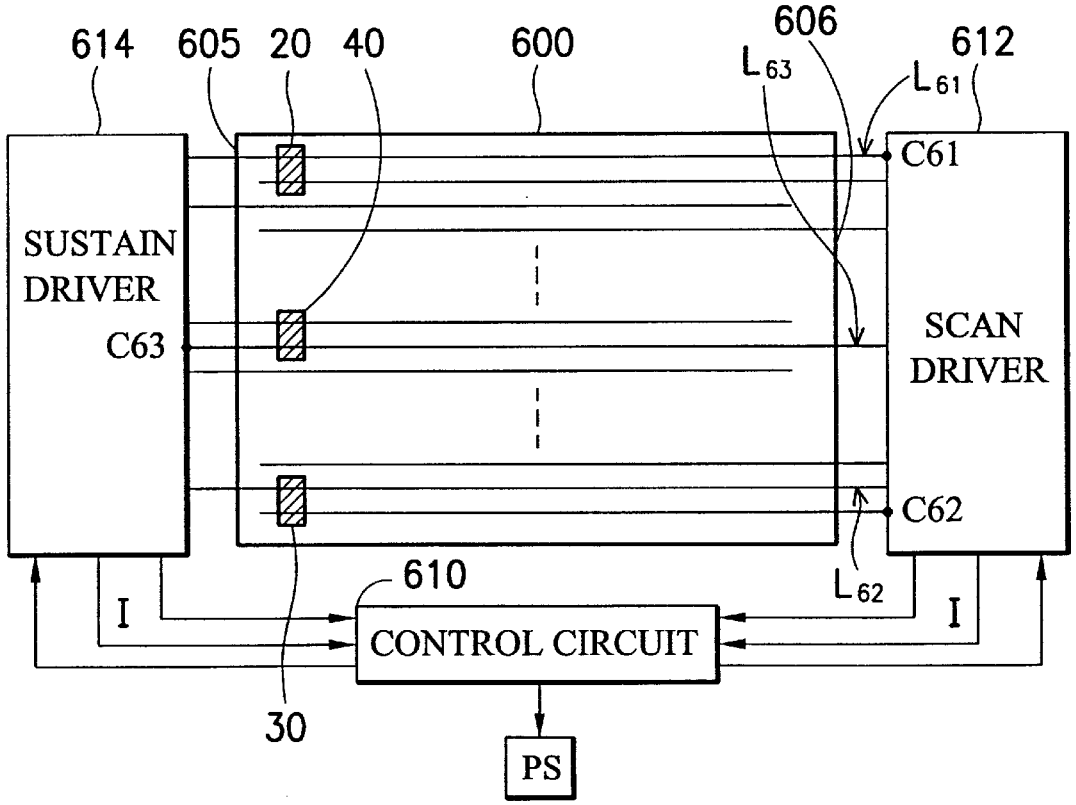
FIG. 6 is a diagram illustrating a plasma display panel according to a second embodiment of this invention.

Referring to FIG. 6, another device of detecting cracks in the PDP is provided. In this embodiment, the sustaining electrodes or the scanning electrodes can be used as the detecting wires, and no extra wire is needed.

Figure 9:
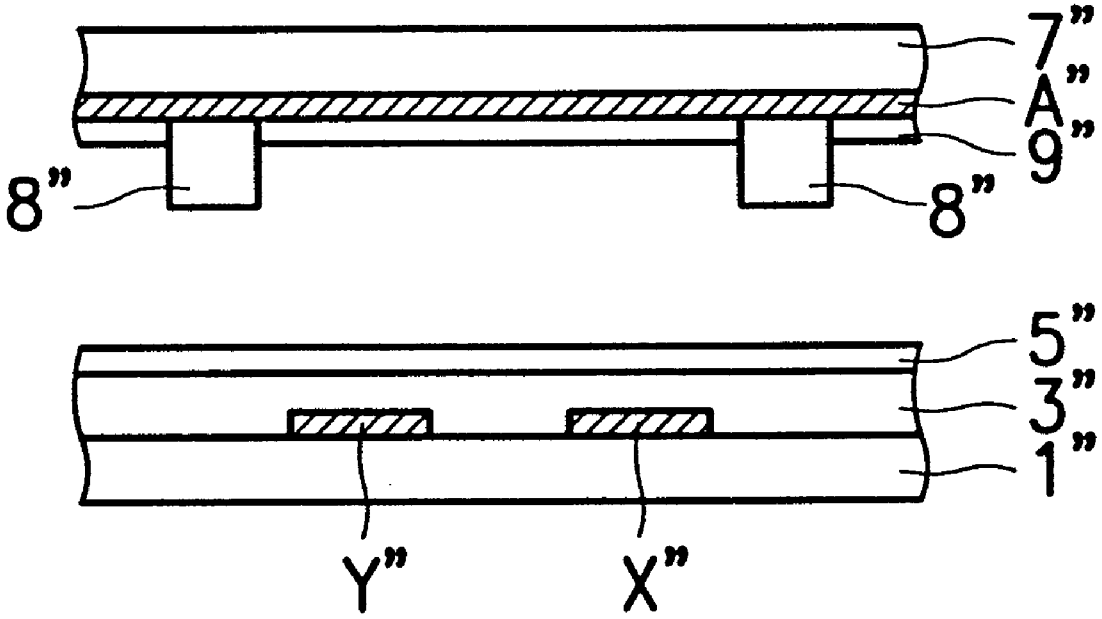
FIG. 9 is a cross-sectional view of a cell in the PDP according to the second embodiment of this invention.

FIG. 9 is a cross-sectional view of a single cell of the plasma display panel (PDP) according to this embodiment. As shown in FIG. 9, the PDP includes a front substrate 1" and a rear substrate 7". The components formed on the substrate 1" include scanning electrodes Y", sustaining electrodes X" positioned parallel to each other, a dielectric layer 3", and a protective film 51". The components formed on the rear substrate 7" include addressing electrodes A" and the fluorescent material 9" formed above the addressing electrodes A". The partition wall 8" is formed on the rear substrate 7" to define each PDP cell.

Refer to FIG. 6., in this embodiment, parts of the sustaining electrodes X" and scanning electrodes Y" are used as the detecting electrodes. These detecting electrodes are formed on the front substrate 1" and extended from the first edge 605 of the front substrate 1" to the opposite second edge 606 of the front substrate 1", such as electrodes $L_{61}$, $L_{62}$, and $L_{63}$. These detecting electrodes $L_{61}$, $L_{62}$, and $L_{63}$ are used not only as the sustaining electrodes X" or scanning electrodes Y" but also as the detecting wires. Therefore, electrodes $L_{61}$, $L_{62}$, and $L_{63}$ can be called as hybrid electrodes. The sustaining electrodes X" and the scanning electrodes Y" are coupled to the sustain driver 614 and the scan driver 612 respectively. The extended electrodes $L_{61}$, $L_{62}$, and $L_{63}$ are further coupled to the signal receivers C61, C62, C63, respectively. In the embodiment, no signal transmitter is needed. The control circuit 610 receives the signals from the signal receivers C61, C62, C63 and has the ability to stop the operations of the sustain driver 614 and the scan driver 612 or the ability to turn off the power supply PS.

Figure 1:
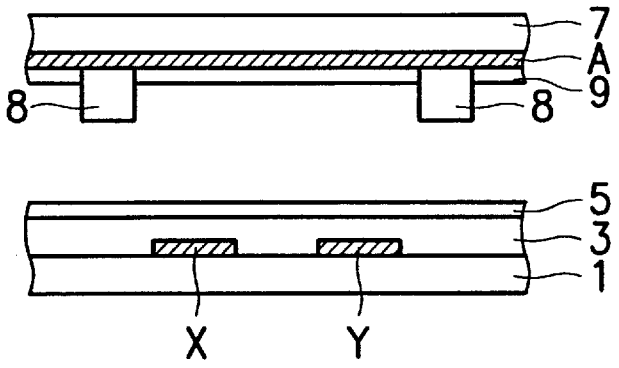
FIG. 1 ( PRIOR ART )
FIG. 1 is a cross-sectional view of a single cell of a plasma display panel (PDP) of a prior art.
Figure 2:
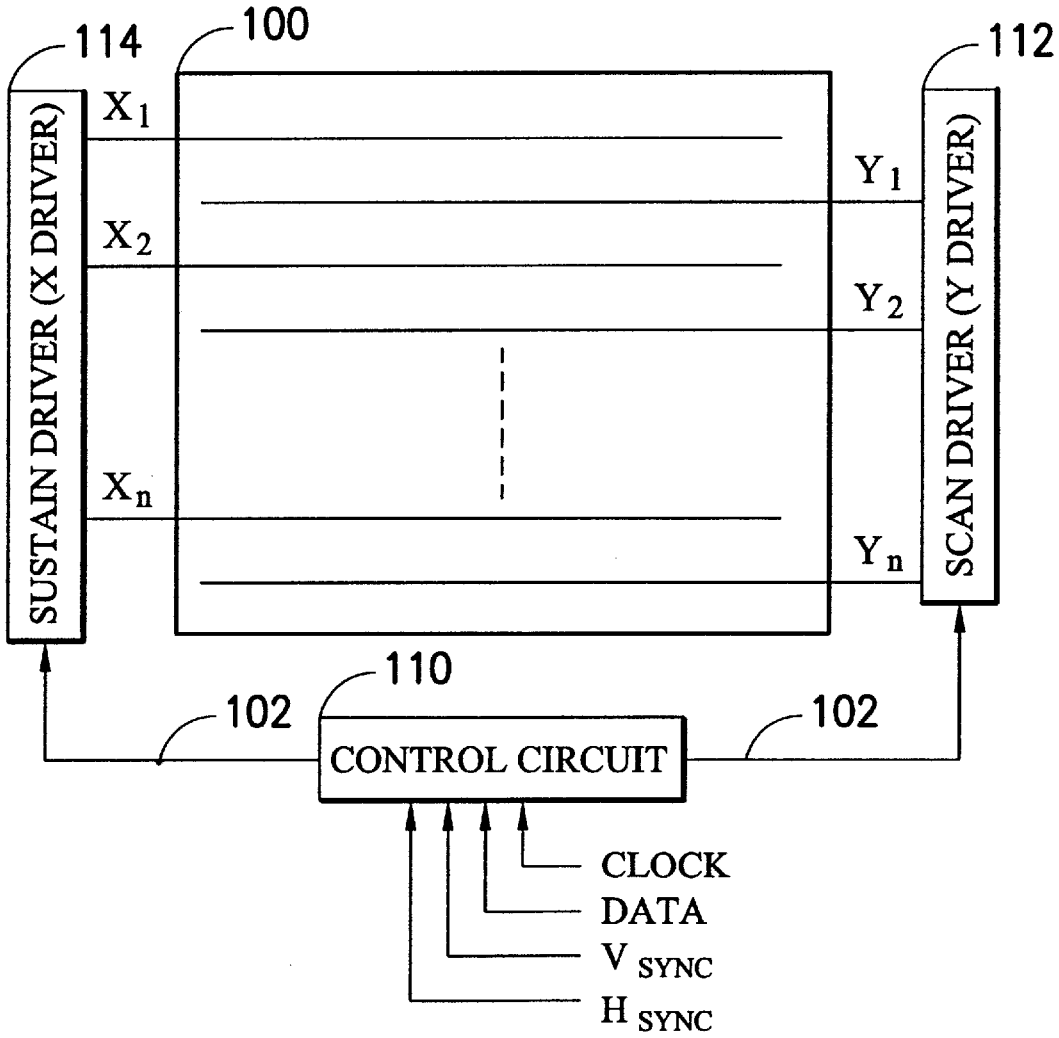
FIG. 2 ( PRIOR ART )
FIG. 2 is a block diagram of the conventional PDP shown in FIG. 1.
Figure 3:
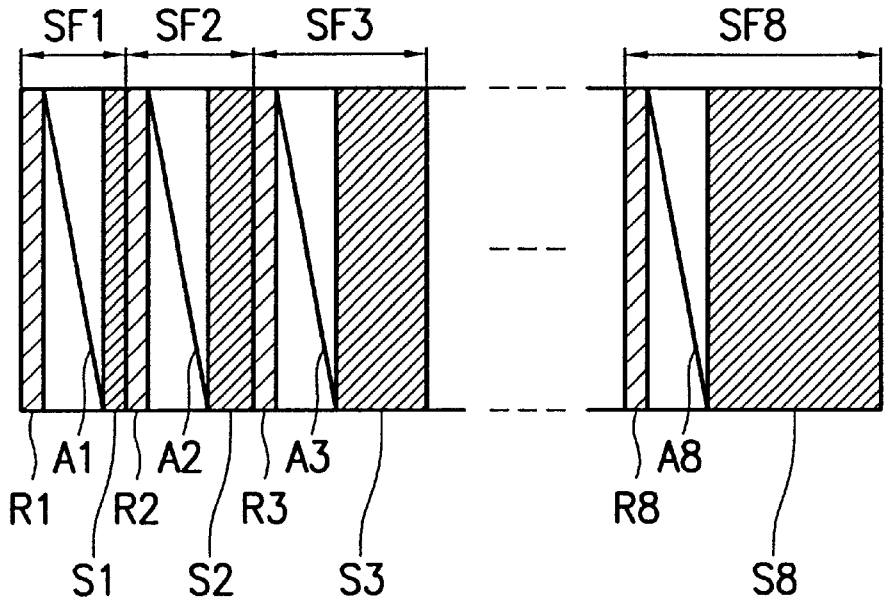
FIG. 3 ( PRIOR ART )
FIG. 3 is a diagram illustrating a driving method to display a single frame of the PDP according to the prior art.
Figure 4:
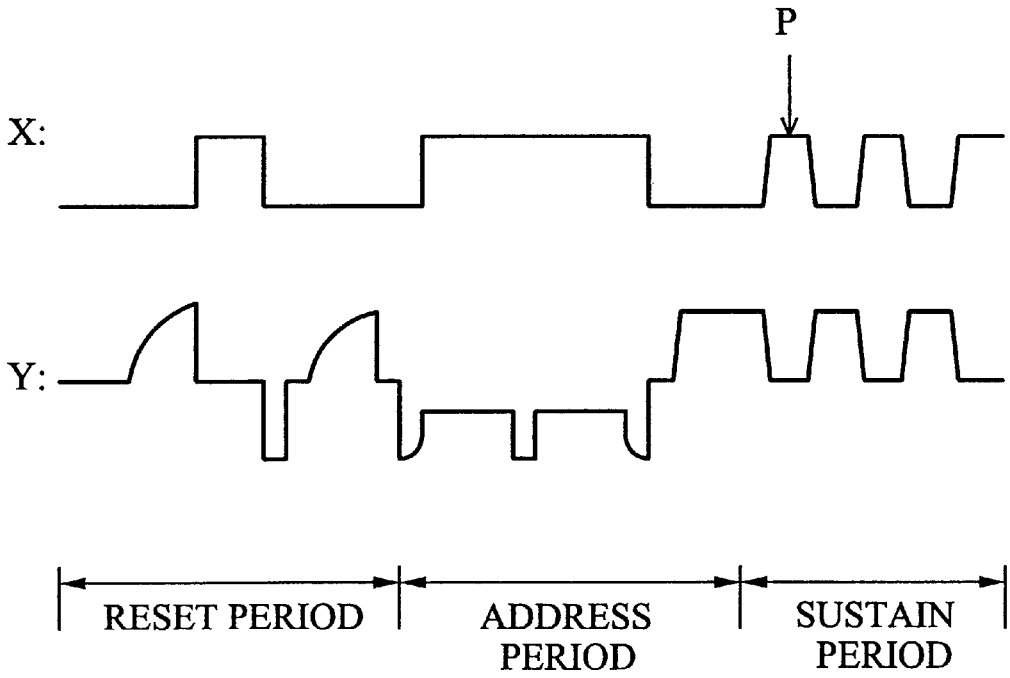
FIG. 4 is a timing diagram of the control signals for the sustaining electrodes and the scanning electrodes in a single sub-field of the prior art.

In this embodiment, the PDP has several hybrid electrodes $L_{61}$, $L_{62}$, and $L_{63}$, but no signal receiver. When the whole system is normal, the waveform of these electrodes is shown in FIG. 4.

Figure 7:
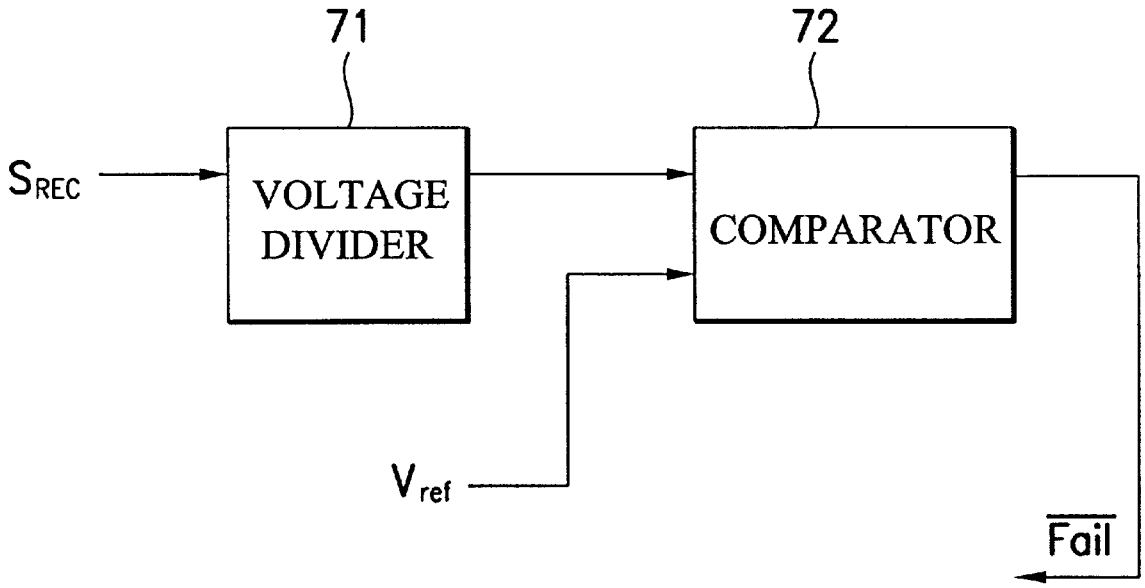
FIG. 7 is a block diagram of a signal receiver according to the second embodiment of this invention.

The signal receivers C61, C62 will check the voltages of the detecting electrodes $L_{61}$, $L_{62}$ at a specified point P at the timing sequence. If the voltage is different from that of the predetermined waveform, it is assumed the electrodes $L_{61}$, $L_{62}$ are open due to cracks in the panel, or the sustain driver 614 does not work normally. Therefore, the signal receivers C61, C62 will send a notifying signal I to the control circuit 610 for stopping the operation of the plasma display panel. Similarly, the signal receivers C63 detects if the voltage of the electrodes $L_{63}$ is normal. When receiving the notifying signals from the signal receivers C61, C62, C63, the control circuit 610 interrupts the bias applied between the sustaining electrodes X" and the scanning electrodes Y" and stops the discharge in the pixels 20, 30, 40. Further, the control circuit 610 can also stop the operations of the sustain driver 614 or the scan driver 612, and turn off the power supply PS of the plasma display panel. FIG. 7 is a block diagram of the signal receivers C61, C62, C63, and the operations of the signal receivers C61, C62, C63** will be described as follows.

The plasma display panel further includes a voltage divider 71 and a comparator 72. First, the voltage signal $S_{REC}$, received by any signal receiver via a hybrid electrode, is transmitted to the comparator 72 via the voltage divider 71. Then, the voltage signal $S_{REC}$ is compared with a reference input voltage $V_{ref}$. If the voltage signal $S_{REC}$ is not the same with the predetermined waveform, the comparator 72 will output a signal $\overline{\text{FAIL}}$ to the control circuit 610 to turn off the power supply PS. Then, the control circuit 610 will interrupt the bias between the sustaining electrodes X" and the scanning electrodes Y" so as to stop the operations of the sustain driver 614 and the scan driver 612. The structure of the signal receiver is not limited by the structure described in the invention, any detecting circuit with the same function can also be applied.

In the invention, the PDP having a device for detecting glass cracks has the following advantages. 1. The design is simple and easy to practice, which is suitable for the characteristics of a plasma display panel. 2. The device also includes an automatic self-detecting function of the sustain driver and the scan driver.

The design of the electrodes with hybrid functions in the invention is not limited to the structure mentioned above. The number and the position of the hybrid electrodes can be varied according to different conditions. The signal receiver also has another different structure, such as analog-to-digital method (A–D), sample-and-hold method, and . . . etc.

Finally, while the invention has been described by way of example and in terms of the preferred embodiment, it is to be understood that the invention is not limited to the disclosed embodiments. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A plasma display panel having a plurality of pixels, a plurality of sustaining electrodes, and a plurality of scanning electrodes, a discharge operation being performed in the plurality of pixels when a bias being applied between the plurality of sustaining electrodes and the plurality of scanning electrodes, said plasma display panel comprising:

a front substrate having a first edge and a second edge in opposition to each other;

a scan driver disposed on the first edge of said front substrate;

a signal receiver disposed on the second edge of said front substrate;

a detecting wire formed on the front substrate, said detecting wire having a first end and a second end, the first end being coupled to said scan driver, and the second end being coupled to the signal receiver; and a control circuit coupled to said scan driver and said signal receiver, wherein when a scan driving signal is delivered by said scan driver and is not received by said signal receiver, said control circuit interrupts the bias applied between the plurality of sustaining electrodes and the plurality of scanning electrodes so as to stop the discharge operation in the plurality of pixels.

2. The plasma display panel as claimed in claim 1, wherein a notifying signal is transmitted to said control circuit so as to stop the operation of said plasma display panel when said signal receiver does not receive said scan driving signal.

3. The plasma display panel as claimed in claim 2, wherein said plasma display panel further comprises a power supply, and said power supply is turned off after said control circuit receives said notifying signal.

4. The plasma display panel as claimed in claim 2, wherein said control circuit stops the operation of said scan driver after receiving said notifying signal.

5. The plasma display panel as claimed in claim 1 further comprising:

a rear substrate positioned opposite to said front substrate and having a plurality of addressing electrodes;

a dielectric layer covered said sustaining electrodes and said scanning electrodes; and a protective film covered said dielectric layer.

6. A plasma display panel having a plurality of pixels, a plurality of sustaining electrodes, and a plurality of scanning electrodes, a discharge operation being performed in the plurality of pixels when a bias being applied between the plurality of sustaining electrodes and the plurality of scanning electrodes, said plasma display panel comprising:

a front substrate having a first edge and a second edge in opposition to each other;

a signal receiver disposed on said first edge of said front substrate;

a sustain driver disposed on said second edge of said front substrate;

a detecting wire disposed on said front substrate, said detecting wire having a first end and a second end, said first end being coupled to said sustain driver, and said second end being coupled to said signal receiver; and a control circuit coupled to said sustain driver and the signal receiver, wherein when a sustain driving signal is delivered by said sustain driver and is not received by said signal receiver, said control circuit interrupts the bias applied between the plurality of sustaining electrodes and the plurality of scanning electrodes so as to stop the discharge operation in the plurality of pixels.

7. The plasma display panel as claimed in claim 6, wherein a notifying signal is transmitted to said control circuit so as to stop the operation of said plasma display panel when said signal receiver does not receive said sustain driving signal.

8. The plasma display panel as claimed in claim 7, wherein said plasma display panel further comprises a power supply, and said power supply is turned off when said control circuit receives said notifying signal.

9. The plasma display panel as claimed in claim 7, wherein said control circuit stops the operation of said sustain driver after receiving said notifying signal.

10. The plasma display panel as claimed in claim 6 further comprising:

a rear substrate positioned opposite to said front substrate and having a plurality of addressing electrodes;

a dielectric layer covered said sustaining electrodes and said scanning electrodes; and a protective film covered said dielectric layer.

11. A plasma display panel having a plurality of pixels, a plurality of sustaining electrodes, and a plurality of scanning electrodes, a discharge operation being performed in the plurality of pixels when a bias being applied between the plurality of sustaining electrodes and the plurality of scanning electrodes, said plasma display panel comprising:

a front substrate having a first edge and a second edge in opposition to each other;

a signal transmitter disposed on said first edge of said front substrate;

a signal receiver disposed on said second edge of said front substrate;

a detecting wire disposed on said front substrate, said detecting wire having a first end and a second end, said first end being coupled to said signal transmitter, and said second end being coupled to said signal receiver; and a control circuit, coupled to said signal transmitter and the signal receiver, wherein when a detecting signal is transmitted by said signal transmitter and is not received by said signal receiver, said control circuit interrupts the bias applied between the plurality of sustaining electrodes and the plurality of scanning electrodes so as to stop the discharge operation in the plurality of pixels.

12. The plasma display panel as claimed in claim 11, wherein a notifying signal is transmitted to said control circuit so as to stop the operation of said plasma display panel when said signal receiver does not receive said detecting signal.

13. The plasma display panel as claimed in claim 12, wherein said plasma display panel further comprises a power supply, and said power supply is turned off when said control circuit receives said notifying signal.

14. The plasma display panel as claimed in claim 11 further comprising:

a rear substrate positioned opposite to said front substrate and having a plurality of addressing electrodes;

a dielectric layer covered said sustaining electrodes and said scanning electrodes; and a protective film covered said dielectric layer.

* * * * *